US007967050B2

(12) United States Patent
Gutierrez

(10) Patent No.: US 7,967,050 B2
(45) Date of Patent: Jun. 28, 2011

(54) ADJUSTABLE PITCH POWER AWNING HARDWARE

(75) Inventor: Roberto Gutierrez, El Paso, TX (US)

(73) Assignee: Dometic LLC, Elkhart, IN (US)

( * ) Notice: Subject to any disclaimer, the term of this patent is extended or adjusted under 35 U.S.C. 154(b) by 302 days.

(21) Appl. No.: 12/274,792

(22) Filed: Nov. 20, 2008

(65) Prior Publication Data

US 2010/0122777 A1 May 20, 2010

(51) Int. Cl.
*E04F 10/06* (2006.01)

(52) U.S. Cl. ..... 160/67; 160/71

(58) Field of Classification Search ..... 160/67, 160/69, 70, 71, 22, 78, 79, 80; 135/88.11, 135/88.12
See application file for complete search history.

(56) References Cited

U.S. PATENT DOCUMENTS

| | | | | | |
|---|---|---|---|---|---|
| 3,591,869 | A | | 7/1971 | Manning | |
| 3,923,074 | A | * | 12/1975 | McKee | 160/22 |
| 4,117,876 | A | * | 10/1978 | Bennett | 160/67 |
| 4,160,458 | A | * | 7/1979 | Marcellus | 160/67 |
| 4,164,972 | A | | 8/1979 | Bennett | |
| 4,508,126 | A | * | 4/1985 | Everard | 160/67 |
| 4,576,192 | A | | 3/1986 | Duda | |
| 4,819,707 | A | * | 4/1989 | Watson et al. | 160/67 |
| 5,174,352 | A | | 12/1992 | Murray et al. | |
| 5,752,556 | A | | 5/1998 | Steadman | |
| 5,896,908 | A | | 4/1999 | Kaun | |
| 5,924,465 | A | * | 7/1999 | Malott | 160/67 |
| 6,095,221 | A | * | 8/2000 | Frey, Jr. | 160/67 |
| 6,098,693 | A | | 8/2000 | Frey, Jr. | |
| 6,273,172 | B1 | * | 8/2001 | Frey | 160/67 |
| 6,488,069 | B1 | | 12/2002 | Mashaw et al. | |
| 6,971,433 | B2 | | 12/2005 | Wagner et al. | |
| 7,281,560 | B2 | | 10/2007 | Hicks et al. | |
| 7,290,742 | B2 | | 11/2007 | Wang | |
| 2005/0022944 | A1 | | 2/2005 | Humble | |

FOREIGN PATENT DOCUMENTS

| | | | |
|---|---|---|---|
| GB | 935949 | A | 9/1963 |
| GB | 983855 | A | 2/1965 |

OTHER PUBLICATIONS

European Search report for EP09177025, dated Jun. 11, 2010.

* cited by examiner

*Primary Examiner* — David Purol
(74) *Attorney, Agent, or Firm* — Pearne & Gordon LLP

(57) ABSTRACT

An awning assembly includes a canopy, a first and second arm assembly, and a canopy rod. The arm assemblies can each include an adjustable pitch arm assembly configured to adjust the pitch of the canopy. The canopy rod has a first end and a second end each supported by one of the arm assemblies. Manual adjustment of the adjustable pitch arm assemblies is configured to move the ends of the canopy rod. The canopy is movable from a first deployed position to a second deployed position when the adjustable pitch arm assemblies are both manually adjusted from an extended position to a collapsed position. The canopy can be movable from either deployed position to a retracted position without manually adjusting the adjustable pitch arm assemblies. The adjustable pitch arm assemblies can change positions in response to water being collected on the awning assembly to drain the collected water.

23 Claims, 9 Drawing Sheets

ADJUSTABLE PITCH POWER AWNING HARDWARE

BACKGROUND OF THE INVENTION

The present invention relates generally to awning assemblies of the type to be mounted to a substantially vertical support surface.

There are a number of known awning assemblies that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and a deployed position, wherein the roller assembly is extended out away from the wall. When the roller assembly is in the retracted position, the canopy is rolled-up on the roller assembly. When the canopy is in a deployed position, the canopy is unrolled from the roller assembly and extends between the wall and the roller assembly. These awning assemblies are often designed for use with movable support structures such as, for example, recreation vehicles, travel trailers, mobile homes, and the like, but are also usable with fixed structures.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, an awning assembly is provided comprising a canopy, a first arm assembly, a second arm assembly, and a canopy rod. The canopy has an inner edge for connection at a wall and an outer edge. The first arm assembly and the second arm assembly support opposite ends of the canopy. The canopy rod connects to the canopy at the outer edge and has a first end and a second end each supported by one of the first arm assembly and the second arm assembly. The first arm assembly includes a first adjustable pitch arm assembly. Manual adjustment of the first adjustable pitch arm assembly is configured to move the first end of the canopy rod.

In accordance with another aspect of the present invention, an awning assembly is provided comprising a canopy, a first arm assembly, a second arm assembly, and a canopy rod. The canopy has an inner edge for connection at a wall and an outer edge. The first arm assembly and the second arm assembly support opposite ends of the canopy. The canopy rod is connected to the canopy and has a first end and a second end each supported by one of the first arm assembly and the second arm assembly. The first arm assembly includes a first adjustable pitch arm assembly. Manual adjustment of the first adjustable pitch arm assembly is configured to move the first end of the canopy rod. The second arm assembly includes a second adjustable pitch arm assembly. Manual adjustment of the second adjustable pitch arm assembly is configured to move the second end of the canopy rod. The first adjustable pitch arm assembly and the second adjustable pitch arm assembly are both manually adjustable between an extended position and a collapsed position. The canopy is movable from a first deployed position to a first tilted position when the first adjustable pitch arm assembly is manually adjusted from the extended position to the collapsed position. The canopy is movable from the first deployed position to a second tilted position when the second adjustable pitch arm assembly is manually adjusted from the extended position to the collapsed position. The canopy is movable from the first deployed position to a second deployed position when the first adjustable pitch arm assembly and the second adjustable pitch arm assembly are both manually adjusted from the extended position to the collapsed position. The canopy is movable from the second deployed position to a retracted position without manually adjusting the first adjustable pitch arm assembly and without manually adjusting the second adjustable pitch arm assembly.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
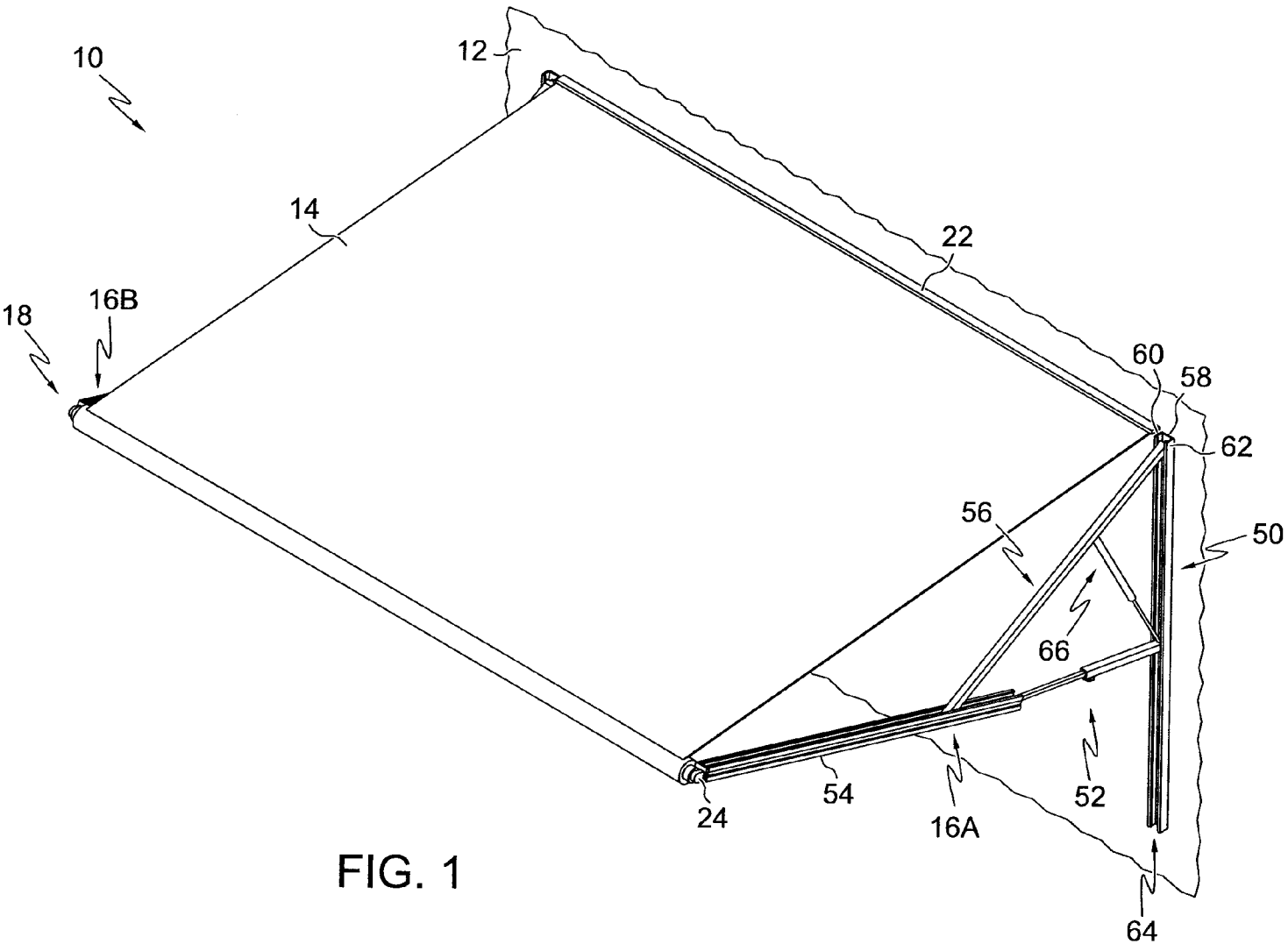
FIG. 1 is a perspective view of a example awning assembly in a first deployed position.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

FIG. 1 illustrates a first example of an awning assembly 10 according to the present invention. The awning assembly 10 is attached to a vertically-extending support wall 12 such as a side of a recreational vehicle. The term "recreational vehicle," as used in the specification and claims, includes campers, travel trailers, mobile homes, vans, buses, and the like. While the awning assembly 10 is particularly advantageous when attached to recreational vehicles, it can alternatively be attached to other vertically-extending walls such as, for example, the side of a building at a patio or deck or any other transportable or fixed structure.

The awning assembly 10 can be manually or automatically operable to move from a retracted position (FIG. 3) to a first deployed position (FIG. 1). For example, the awning assembly 10 can include a manual or automatic extension and retraction mechanism to deploy and retract the awning assembly 10. The extension and retraction mechanism can be of any suitable type. See, for example, application Ser. No. 09/519,779 filed Mar. 7, 2000, disclosing a suitable extension and retraction mechanism which is herein incorporated by reference. Other powered retraction mechanisms can also be used with the awning assembly 10.

Figure 2:
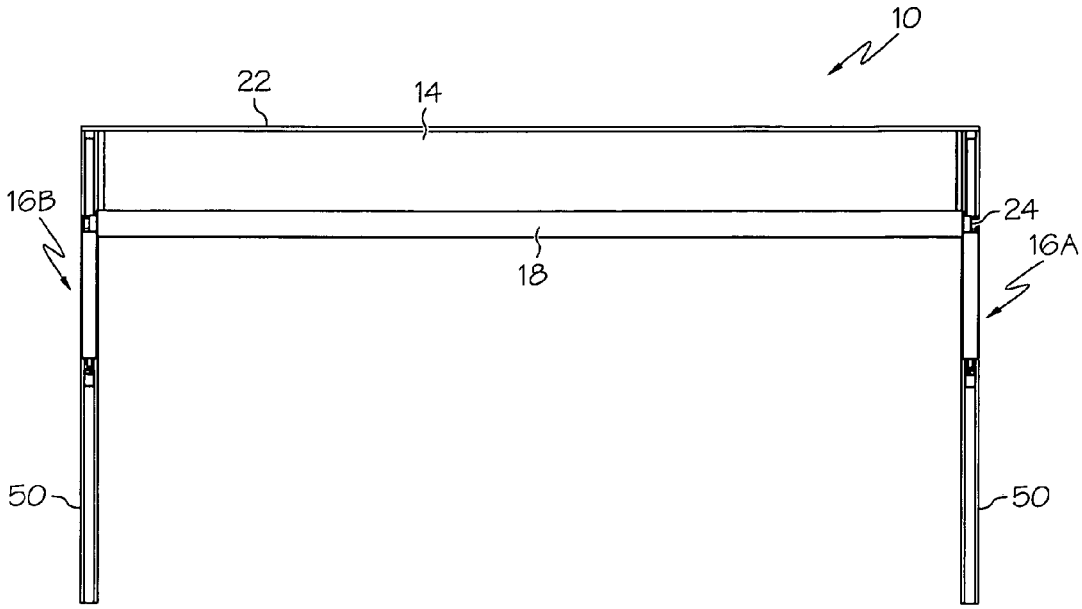
FIG. 2 is a front view of the example awning assembly of FIG. 1 in the first deployed position.

A front view of the first deployed position of FIG. 1 is shown in FIG. 2. In the first deployed position, the awning assembly 10 provides a covering position to protect against sun, rain, and the like. The awning assembly 10 includes a canopy 14 for selectively covering an area adjacent to the wall 12 and a first arm assembly 16A and a second arm assembly 16B, on the opposite side of the canopy 14, for directly or indirectly supporting the canopy 14 by supporting opposite ends of the canopy 14. The second arm assembly is substantially similar to the first arm assembly 16A as the second arm assembly is not visible in FIG. 1 due to the position of the canopy 14.

The canopy 14 can be a sheet of flexible material such as, for example, fabric, canvas, acrylic, or nylon and can be rectangularly shaped. An inner edge of the canopy 14 is secured to the support wall 12 and an outer edge of the canopy 14 is connected or secured to a canopy rod 18. The canopy rod 18 includes a first end and a second end each supported by one of the first arm assembly 16A and the second arm assembly 16B. The inner and outer edges of the canopy 14 can be provided with an awning rope or other suitable cylindrical member. The awning rope can be a polypropylene rope and can be sewn in a hem or pocket formed at the edges of the canopy 14.

The rope at the inner edge of the canopy 14 can be held by an awning rail 22 which extends horizontally along and is fixedly attached to the support wall 12 by suitable fasteners. The inner edge of the canopy 14 can be alternatively secured to the support wall 12 in other manners such as, for example, directly to the support wall 12 or to a cover attached to the wall 12. The awning rope at the outer edge of the canopy 14 is held by the canopy rod 18. The canopy rod 18 further includes a roller assembly 24 as will be described in more detail.

As shown in FIG. 1, each arm assembly 16A, 16B can be a four bar linkage including a base arm 50, an adjustable pitch arm assembly 52, an extended arm 54, and a top arm 56. Each arm assembly 16A, 16B is disposed in a generally vertical plane at an associated side edge of the canopy 14 and at an associated end of the canopy rod 18. Each of the arms 50, 52, 54, 56 is substantially straight and elongate. The base arm 50, the adjustable pitch arm assembly 52, the extended arm 54, and the top arm 56 can be comprised of extrusions of a light weight, high strength material such as an aluminum alloy. The base arm 50 has a main wall 58, an inner sidewall 60, and an outer sidewall 62. The inner sidewall 60 and the outer sidewall 62 perpendicularly extend from opposed side edges of the main 58 wall to form a vertically extending and outward facing channel 64. The channel 64 is outward facing so that it at least partially receives the top arm 56 and the adjustable pitch arm assembly 52 when the canopy 14 is in a retracted position of FIG. 3.

Figure 3:
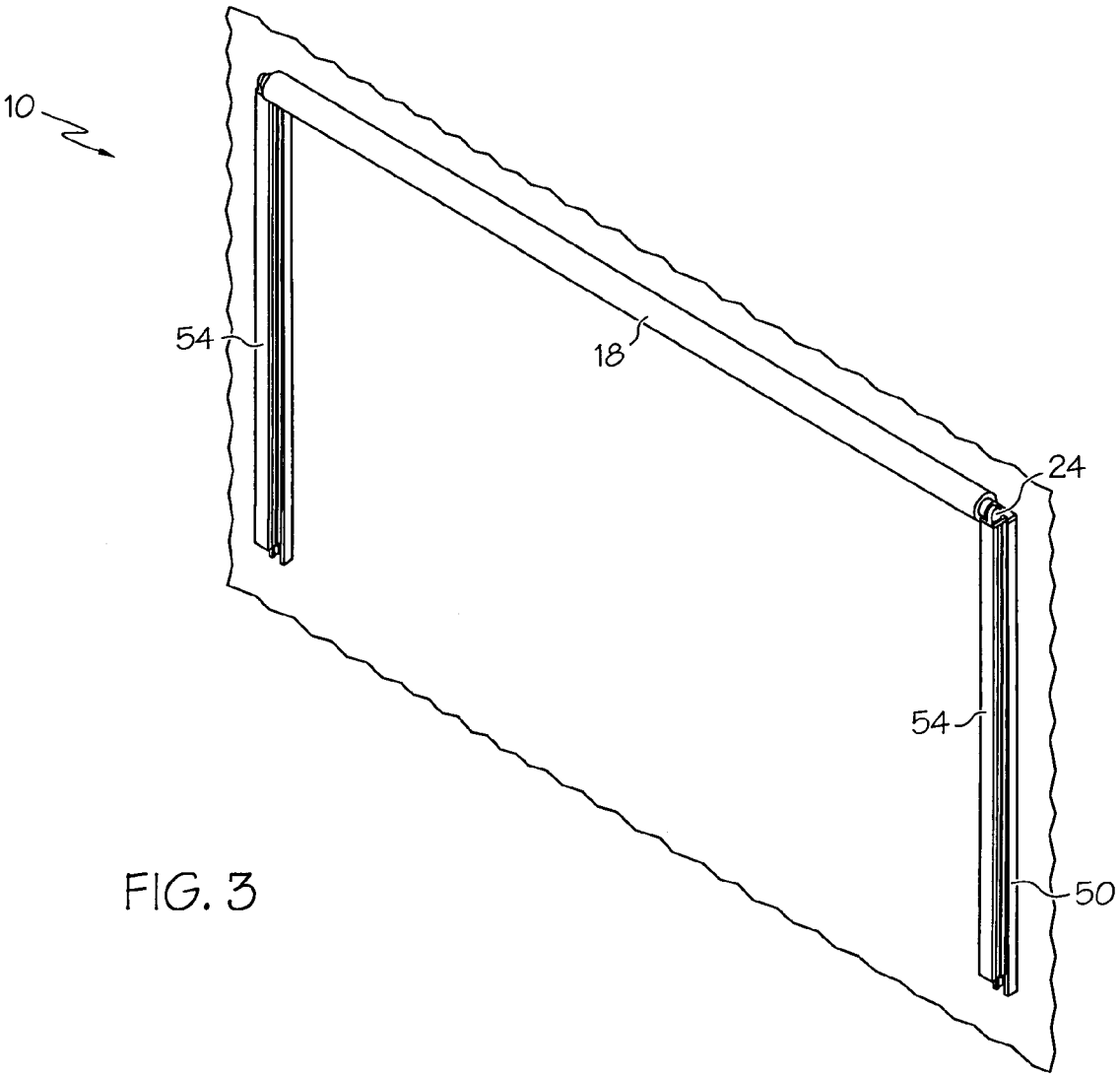
FIG. 3 is a perspective view of the example awning assembly in a retracted position.

In the retracted position of FIG. 3, the system of pivotally attached bars or arms 50, 52, 54, 56 fold into a compact stack against the wall 12, by stacking the adjustable pitch arm assembly 52 and the top arm 56 within the channel 64 of the base arm 50 and a channel of the extended arm 54. The base arm 50 can be secured or connected to the support wall 12 through the use of brackets or other attachment devices. As shown in FIG. 1, the upper end of the extended arm 54 supports the roller assembly 24. The upper end of the extended arm 54 can be provided with an upper end cap which has a socket into which the upper end of the extended arm 54 is closely received and rigidly secured. The upper end cap can be secured to the extended arm 54 by rivets, but can be alternatively secured in other manners.

Figure 5:
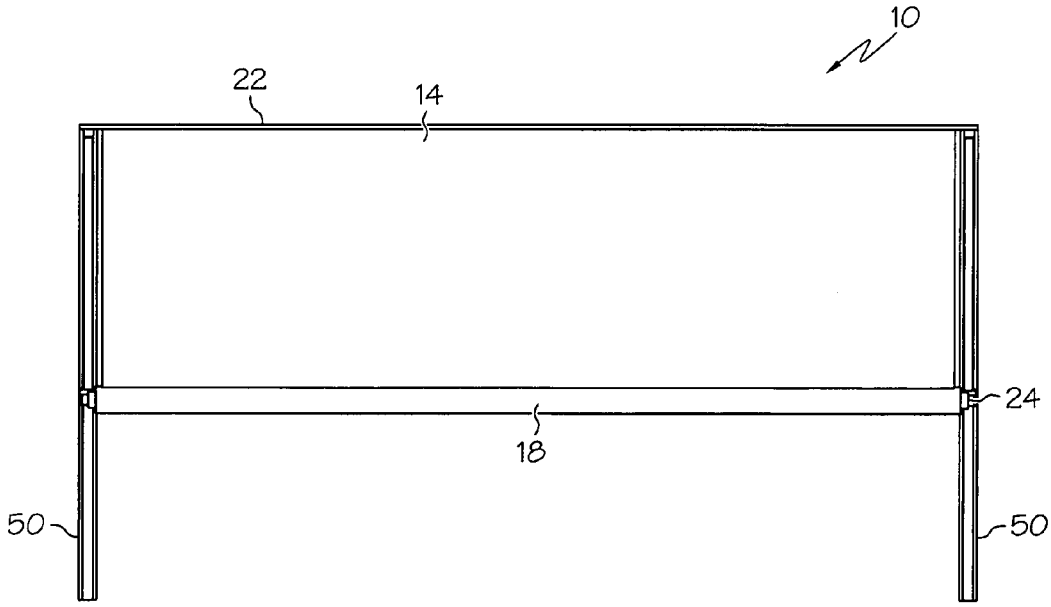
FIG. 5 is a front view of the example awning assembly of FIG. 4 in the second deployed position.
Figure 4:
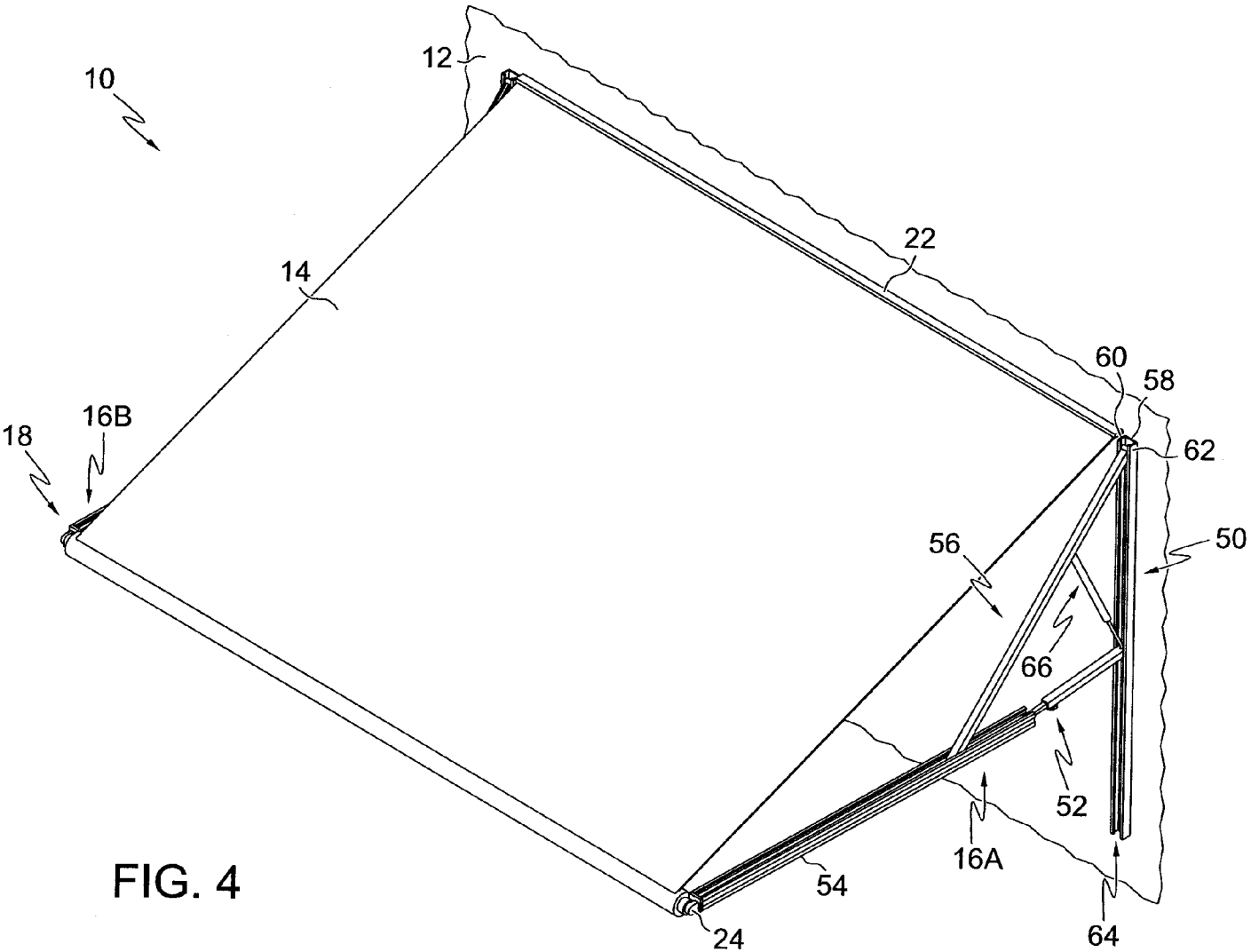
FIG. 4 is a perspective view of a example awning assembly in the second deployed position.

The awning assembly 10 can be manually or automatically operable to move into the retracted position from the first deployed position of FIG. 1 or from any other intermediate position to the second deployed position of FIG. 4. The awning assembly 10 can be configured to move between the retracted position and the first deployed position by simply the push of a button. A front view of the second deployed position of FIG. 4 is shown in FIG. 5. In the second deployed position, the awning assembly 10 provides a covering position to protect against sun, rain, and the like. The second deployed position of FIG. 4 can be a position where the roller assembly 24 is located at a different vertical position relative to the first deployed position. In addition, the second deployed position can be a position where the roller assembly 24 is located at a different vertical position and a different horizontal position relative to the first deployed position. As shown in FIG. 4, the canopy rod 18 can include the roller assembly 24 that includes a roller tube. The roller tube can include at least two outer ends supported by the arm assemblies. The roller assembly 24 rotates to unwind the canopy 14 from the roller assembly 24. Thus, the awning assembly 10 can be manually adjusted which can also adjust the angle of the canopy 14. It is appreciated that in any of the examples, the amount of fabric of the canopy 14 that is unwound from the roller assembly 24 can also be adjusted between a minimum amount being unwound and a maximum amount being unwound by rotating the roller assembly 24 in either the clockwise or counterclockwise direction.

Figure 6:
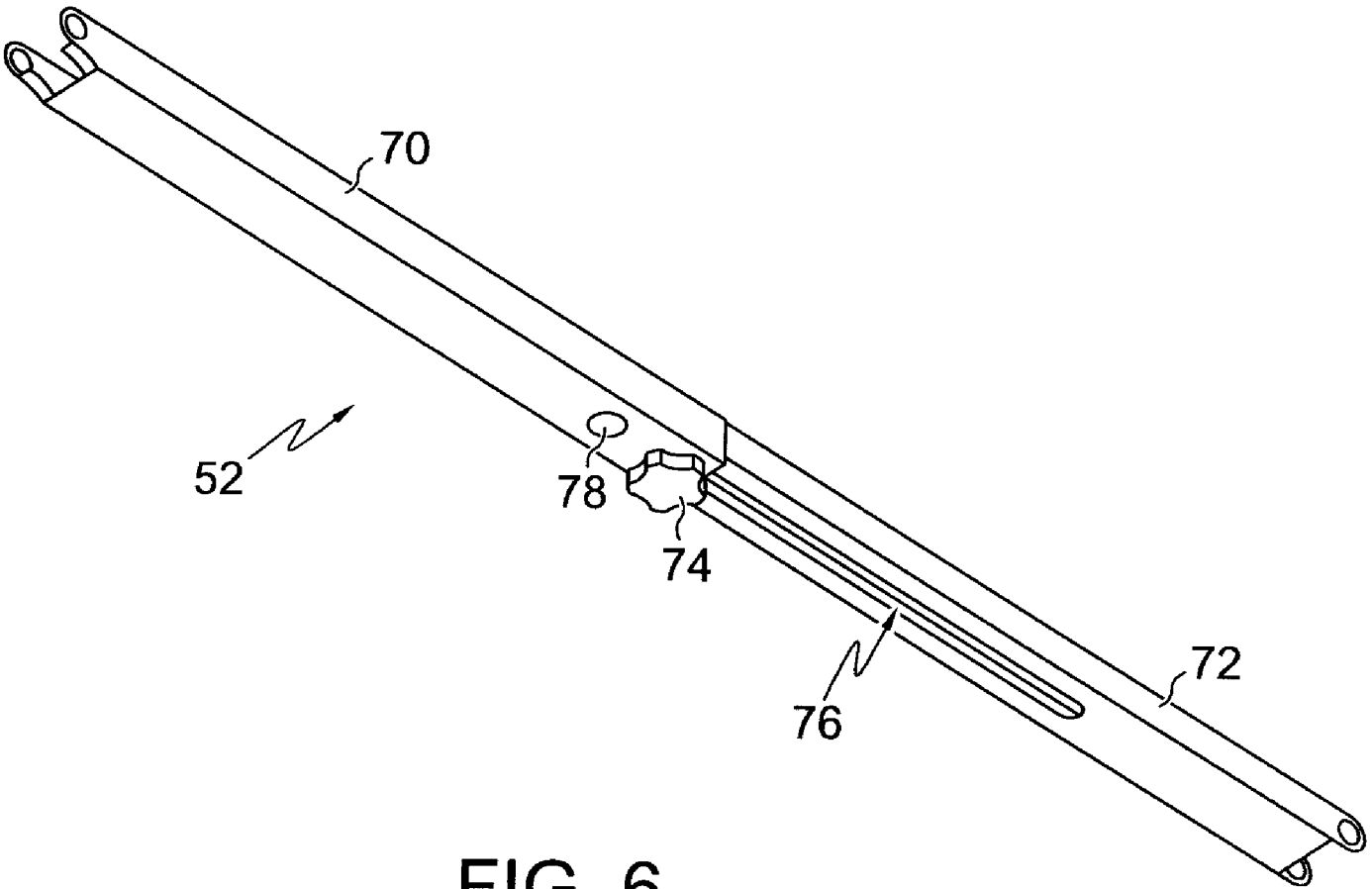
FIG. 6 is a perspective view of an adjustable pitch arm assembly of FIG. 1.

An example of the adjustable pitch arm assembly 52 is shown in FIG. 6. A first adjustable pitch arm assembly 52 can be located on the first arm assembly 16A and a second adjustable pitch arm assembly can be located on the second arm assembly 16B. It is appreciated that one adjustable pitch arm assembly is shown and that both adjustable pitch arm assemblies can include the same structure. Manual adjustment of the first adjustable pitch arm assembly 52 is configured to move the first end of the canopy rod 18. Manual adjustment of the second adjustable pitch arm assembly is configured to move the second end of the canopy rod 18. For example, the first adjustable pitch arm assembly 52 can be configured to move the right end of the canopy rod 18 and the second adjustable pitch arm assembly 52 can be configured to move the left end of the canopy rod 18. Each adjustable pitch arm assembly 52 can be manually adjusted between an extended position and a collapsed position. In another example, the adjustable pitch arm assembly 52 can include a first member 70 and a second member 72 where the first member 70 is slidably movable relative to the second member 72. It is appreciated that other configurations, such as two members that move outwardly from a central member, can be provided to allow the adjustable pitch arm assembly 52 to have an extended position and a collapsed position. The adjustable pitch arm assembly 52 can include a lock mechanism 74 that is configured to be placed in either a secured position or an unsecured position. The lock mechanism 74 can be any structure used to secure the first member 70 relative to the second member 72, such as a knob, a latch, a pin, or a fastener that applies a clamping force to limit movement between the first member 70 and the second member 72. The secured position can secure the first member 70 relative to the second member 72 in a position, such as the extended position, the collapsed position, or any position between the extended position and the collapsed position. The unsecured position of the lock mechanism 74 allows a user to manually adjust the adjustable pitch arm assembly 52 between the extended position and the collapsed position.

In one example, the adjustable pitch arm assembly 52 can include a c-shaped inner channel within the first member 70, a box-shaped outer channel within the second member 72, a lock mechanism 74 with a threaded stud insert and nut combination for temporarily setting the end-to-end distance, a slot 76, and a cross-member 78 combination. The slot 76 can be in the first member 76 and the cross-member 78 can be within the second member 72 though the locations of the slot 76 and the cross-member 78 can be reversed. The cross-member 78 limits the travel of the first member 70 with respect to the second member 72. The first member 70 can slidably move into the second member 72. The first member 70 can be tubular in cross-section. The outer end of the first member 70 can be slidably received by the second member 72. The first member 70 is sized to fit within the tubular second member 72 so that it can longitudinally move in a telescoping manner. It is appreciated that in other examples, the second member 72 can slidingly fit within the first member 70.

The lock mechanism 74, which in one example can be a knob that is rotatable, is provided to allow the adjustable pitch arm assembly 52 to be secured into the position desired by the user. For example, the user can loosen the lock mechanism 74 into an unsecured position and then move the first member 70 into one of a plurality of positions relative to the second member 72. The user can then tighten the lock mechanism 74 into a secured position that is configured to limit the first member 70 from moving relative to the second member 72. The lock mechanism 74 can be a threaded stud/nut combination which applies a clamping force when in a secured position to a wall in the first member 70 and a corresponding wall in the second member 72. The clamping force applied secures a position of the first member 70 relative to the second member 72. The lock mechanism 74 can be manually adjusted by turning the knob with the threaded stud wherein the threaded stud applies the clamping force to the wall in the first member 70 and the corresponding wall in the second member 72. The clamping force can be of a magnitude great enough to limit the first adjustable pitch arm assembly 52 from changing its effective length when the awning assembly 10 is loaded with rain or water, such that the first adjustable pitch arm assembly 52 will not change its effective length until a relatively large amount of water has been collected. The slot 76 of the adjustable pitch arm assembly 52 can be located on the first member 70 where the slot 76 represents the path of travel for the lock mechanism 74. The cross member 78 can be located on the second member 72 to limit the movement of the first member 70 relative to the second member 72. In further examples, the adjustable pitch arm assembly 52 can include a biasing mechanism, such as a tension spring, that biases the adjustable pitch arm assembly 52 into an extended position, shown in FIG. 7.

Figure 7:
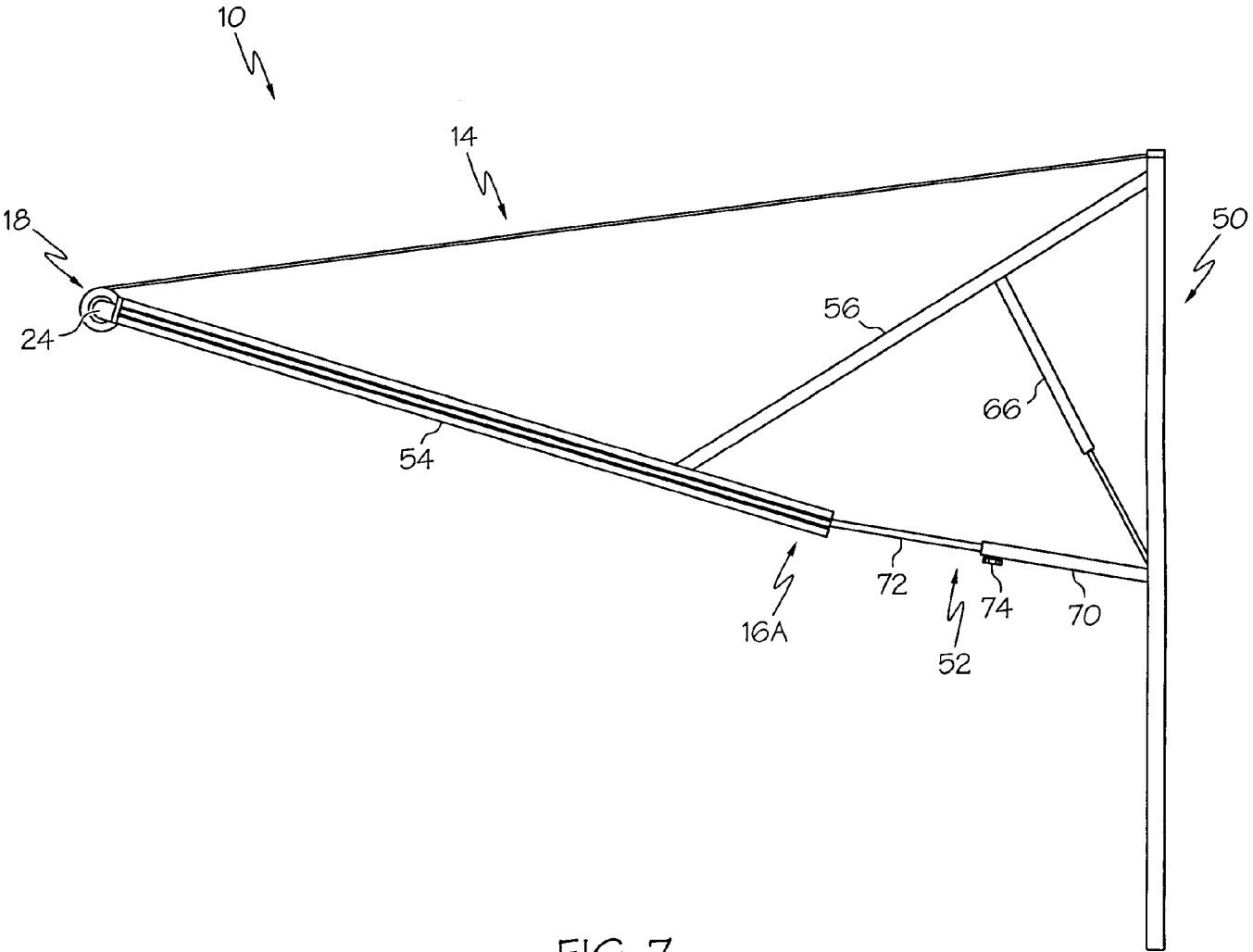
FIG. 7 is a side view of the example awning assembly of FIG. 1 in the first deployed position.
Figure 8:
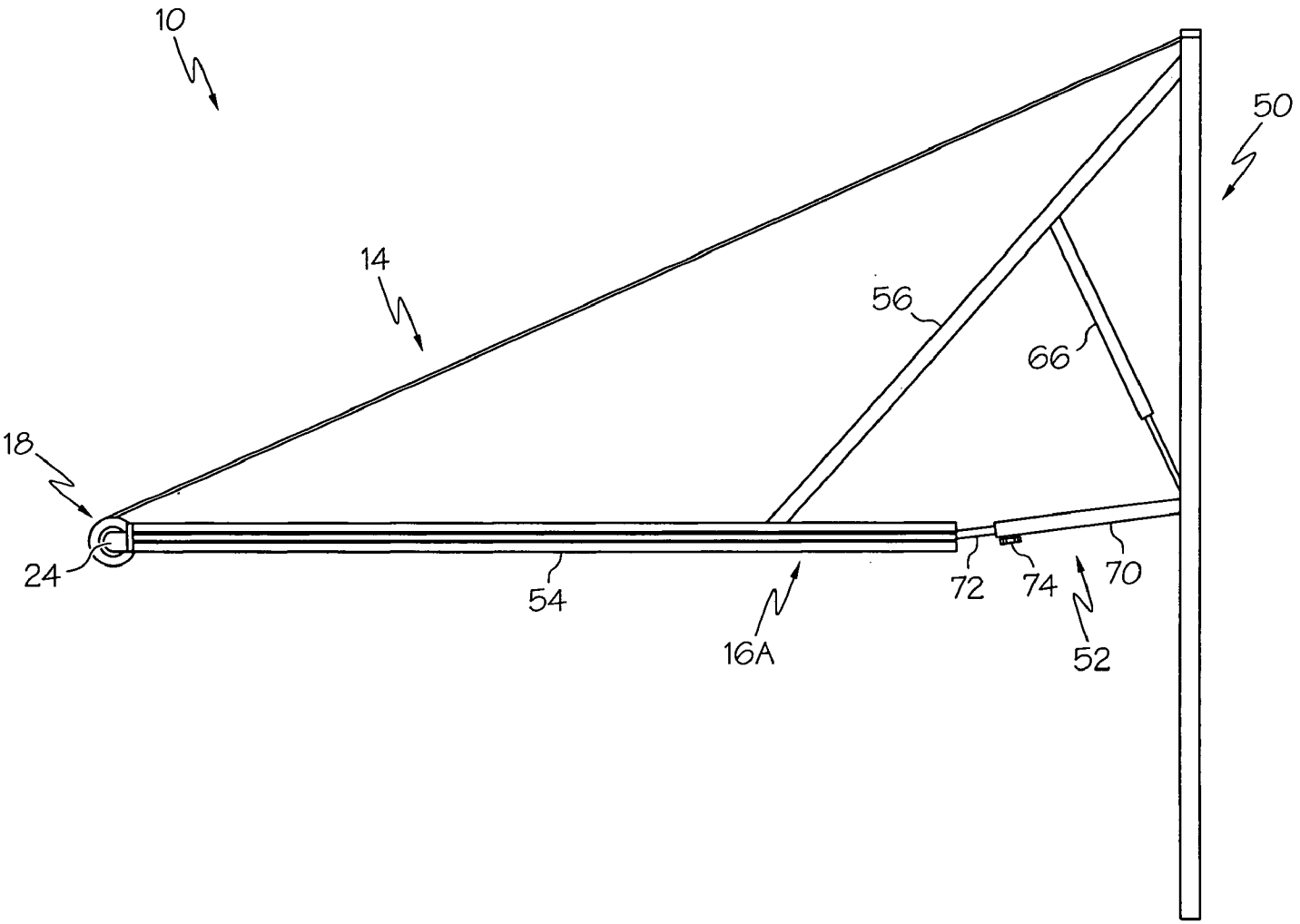
FIG. 8 is a side view of the example awning assembly of FIG. 4 in the second deployed position.

As shown in FIGS. 7 and 8, the structure of the arm assembly 16A is shown as well as the arrangement of the members of the awning assembly 10. The first member 70 of the adjustable pitch arm assembly 52 can have an inner end pivotally mounted or connected to a central or intermediate portion of the base arm 50. The extended arm 54 can have an inner or lower end pivotally mounted to an outer end of the second member 72 and an outer end connected to the end of the roller assembly 24. The top arm 56 can have an inner or upper end pivotally mounted to an upper portion of the base arm 50 and an outer or lower end pivotally mounted to an intermediate portion of the extended arm 54 generally near the lower or inner end of the extended arm 54. The top arm 56 can be tubular in cross-section.

Figure 9:
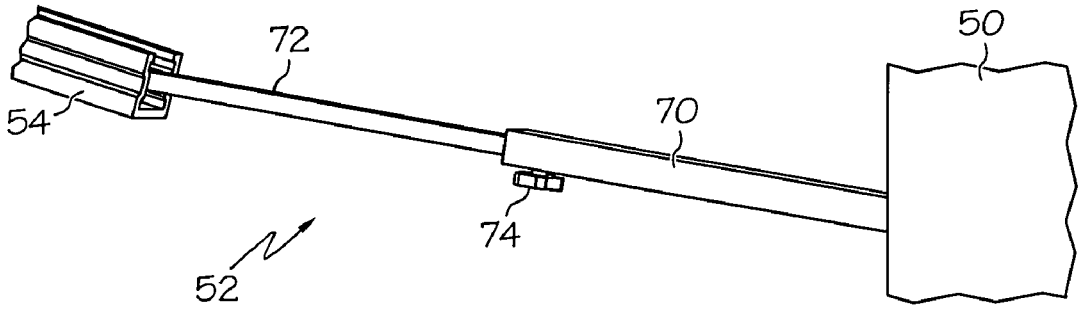
FIG. 9 is a partial side view of the adjustable pitch arm assembly of FIG. 7 in the extended position.
Figure 10:
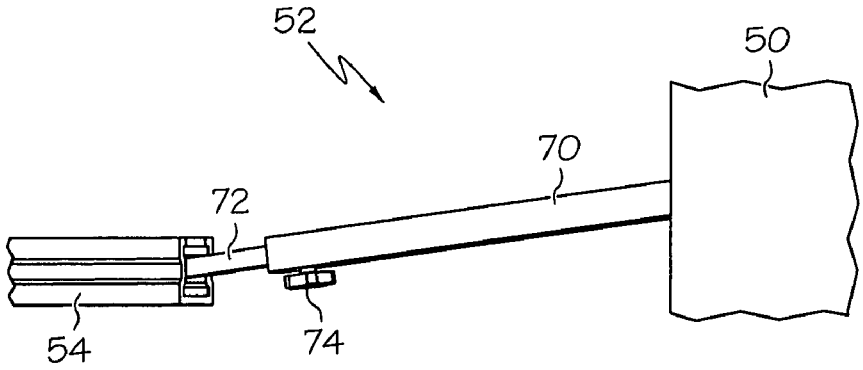
FIG. 10 is a partial side view of the adjustable pitch arm assembly of FIG. 8 in the collapsed position.
Figure 11:
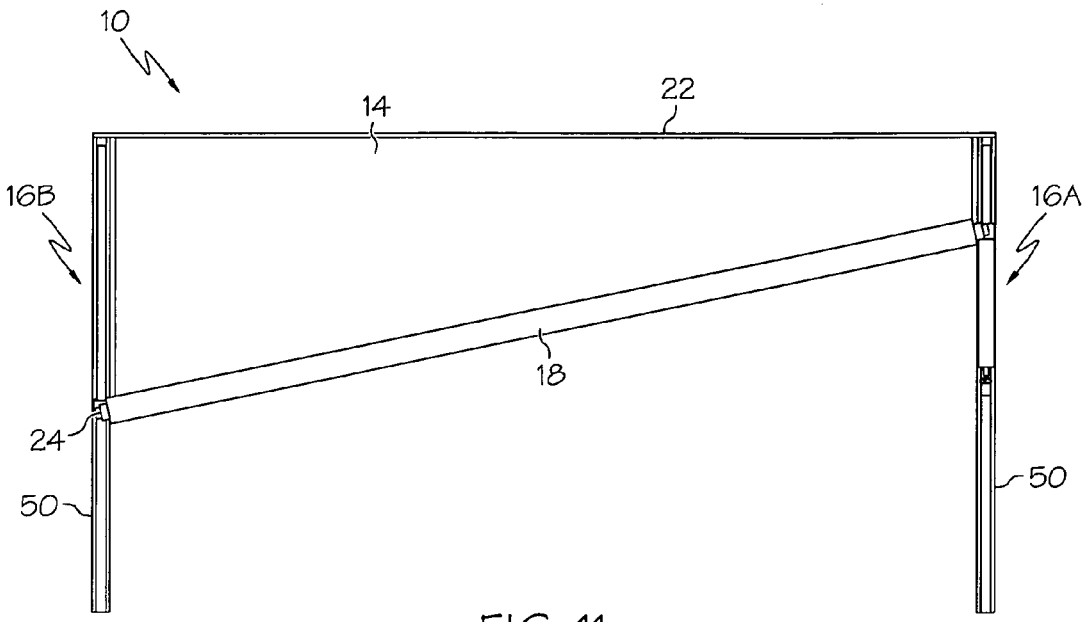
FIG. 11 is a front view of the example awning assembly in the first tilted position.
Figure 12:
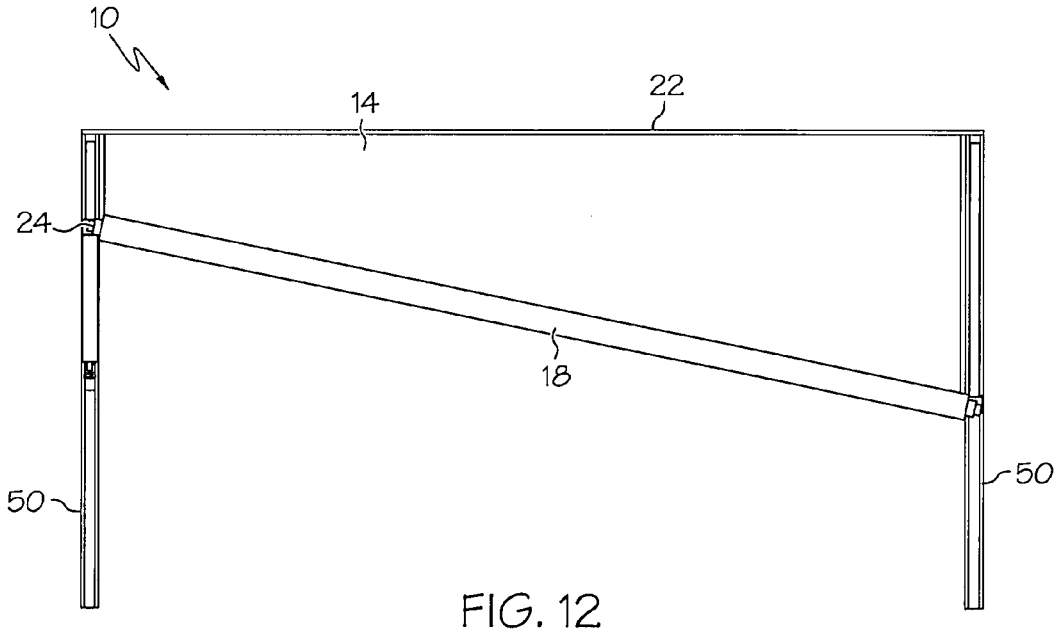
FIG. 12 is a front view of the example awning assembly in the second tilted position.

The adjustable pitch arm assembly 52 can be placed in an extended position, as shown in FIG. 7 and FIG. 9, or in a collapsed position, as shown in FIG. 8 and FIG. 10. A portion of the awning assembly 10 can be lowered, but only if a lock mechanism 74 is first placed in an unsecured position to allow the adjustable pitch assembly 52 to be moved into a collapsed position. If the lock mechanisms 74 for the first adjustable pitch arm assembly and the second adjustable pitch arm assembly are placed in an unsecured position, then the awning assembly 10 can be configured to allow the awning assembly 10 to move from the first deployed position (FIG. 7) into the second deployed position (FIG. 8). The user can manually adjust the first adjustable pitch arm assembly and the second adjustable pitch arm assembly from an extended position to the collapsed position to move the canopy 14 from the first deployed position to the second deployed position. Each lock mechanism 74 can then be placed in a secured position to maintain the awning assembly in the second deployed position (FIG. 8). It is also appreciated that if one of the lock mechanisms 74 of one of the arm assemblies 16A, 16B is placed in the collapsed position and the other lock mechanism 74 of the second arm assembly is in the extended position, the awning assembly 10 can be tilted to the left side or the right side respectively as shown in FIG. 11 and FIG. 12. FIG. 12 can correspond to FIG. 8 respectively as FIG. 8 only shows a partial side view. If the lock mechanism 74 is in a secured position while the adjustable pitch arm assembly is in the extended position of FIG. 7, this will restrict the adjustable pitch arm assembly 52 from moving into a collapsed position, shown in FIG. 8, until a relatively large amount of rain water is on the canopy 14.

As shown in FIG. 7, at least one of the arm assemblies 16A, 16B can also include a strut 66 for supporting the top arm 56 when the awning assembly 10 is in one of the deployed positions. The strut 66 can be a gas strut or other type of suitable structure. An inner end of the strut 66 can be connected to the base arm 50 and an outer end connected to the top arm 56. Both ends of the strut 66 can be provided with pivotable ball end joints such that the strut 66 can be received within the base arm 50 when the awning assembly 10 is in the retracted position. The inner end of the strut 66 can be mounted to the base arm 50 by a lower mounting bracket. The lower mounting bracket is secured to the outer side wall of the base arm 50 at an intermediate portion by any suitable manner such as, for example, rivets or screws. The outer end of the strut 66 can be mounted to the top arm 56 at a central or intermediate portion by any suitable manner such as, for example, a threaded stud of the ball end joint.

The strut 66 is positioned and sized to apply force against the awning assembly 10 and water collected on the canopy 14. The combined force provided by the strut 66 and the securement of the lock mechanism 74 hold the awning assembly 10 at a deployed position until the awning assembly 10 is loaded. When the awning assembly 10 is loaded, the strut 66 can permit a corner of the awning assembly 10 to lower, but only if the lock mechanism 74 is in an unsecured position. If the lock mechanism 74 is in an unsecured position, then the strut 66 of the awning assembly 10 can be configured to allow the awning assembly 10 to move from the first deployed position (FIG. 7) into the second deployed position (FIG. 8). Conversely, when the awning assembly 10, previously loaded, becomes unloaded, the force of the strut 66 can return the awning assembly 10 to the first deployed position. When the lock mechanism 74 is in a secured position, the strut 66 will be prevented from moving into a different position. For example, if the lock mechanism 74 is in a secured position while the adjustable pitch arm assembly 52 is in the extended position of FIG. 7, this will restrict the adjustable pitch arm assembly 52 from moving into a collapsed position, shown in FIG. 8.

As shown in FIGS. 9 and 10, the extended arm 54 can be channel-shaped in cross-section having a main wall and inner and outer side walls perpendicularly extending from opposed side edges of the main wall to form a channel. The channel can face upward when the awning assembly 10 is extended so that it at least partially receives the adjustable pitch arm assembly 52 when in the retracted or stored position of FIG. 3. The extended arm 54 can thus be configured to substantially conceal the first adjustable pitch arm assembly 52, the top arm 56, and the base arm 50 when the canopy 14 is in a retracted position. The first member 70, which slides inside the second member 72 longitudinally, varies the end-to-end distance of the adjustable pitch arm assembly 52. In this example, the end-to-end distance is set via the lock mechanism 74.

In a different example of the adjustable pitch arm assembly 52, the end-to-end distance is set via a pin that can be removed and re-installed into a hole through the outer channel of the first member 70 and a corresponding hole in the inside channel of the second member 72. It should be understood that any structure that applies a temporary clamping force between the first member 70 and the second member 72 would serve the purpose of varying the end-to-end distance of the adjustable pitch arm assembly 52. In any of the examples, as the end-to-end distance of the adjustable pitch arm assembly 52 is reduced, the forward support for the canopy 14 is lowered with respect to the ground. As the forward support for the canopy 14 is lowered with respect to the ground, into a lower position, the angle of the fabric of the canopy 14 can be changed.

In further examples, it is appreciated that either the base arm 50, the extended arm 54, or the top arm 56, shown in FIGS. 1, 4, 7, and 8, can each be the adjustable pitch arm assembly. In any of these alternative examples, 52 can be a bottom arm that is not adjustable. In a first alternative example, the base arm 50 can be the adjustable pitch arm assembly where the base arm 50 is configured to be manually adjusted between an extended position and a collapsed position. The base arm 50 can be configured to adjust the position of an end of the canopy rod 18. The base arm 50 can include two members that move in a telescoping manner. One of the members can be used to move the relative position of at least the end of either the bottom arm 52 or the top arm 56. In a second alternative example, the extended arm 54 can be the adjustable pitch arm assembly where the extended arm 54 is configured to be manually adjusted between an extended position and a collapsed position. The extended arm 54 can be configured to adjust the position of an end of the canopy rod 18. The extended arm 54 can include two members that move in a telescoping manner. In a third alternative example, the top arm 56 can be the adjustable pitch arm assembly where the top arm 56 is configured to be manually adjusted between an extended position and a collapsed position. The top arm 56 can be configured to adjust the position of an end of the canopy rod 18. The top arm 56 can include two members that move in a telescoping manner.

It is appreciated that in any of the alternative examples, other configurations, such as two members that move outwardly from a central member, can be provided to allow the adjustable pitch arm assembly, either 50, 52, 54, or 56, to have an extended position and a collapsed position. The adjustable pitch arm assembly can include a lock mechanism 74, such as the one shown in FIG. 6 that is configured to be placed in either a secured position or an unsecured position. The lock mechanism 74 can be any structure used to secure a first member 70 relative to a second member 72, such as a knob, a latch, a pin, or a fastener that applies a clamping force to limit movement between the first member 70 and the second member 72. The secured position can secure the first member 70 relative to the second member 72 in a position, such as the extended position, the collapsed position, or any position between the extended position and the collapsed position.

As one example of use, a user can extend the awning assembly 10 away from the support wall 12 of a motor vehicle. With the awning assembly 10 fully extended, the user can then manually loosen the lock mechanism 74 on the first adjustable pitch arm assembly 52 or the second adjustable pitch arm assembly. It is appreciated that the adjustable pitch arm assembly can be represented by any of the arms 50, 52, 54, 56 and that the description pertaining to the arm 52 being used as the first adjustable pitch arm assembly is by way of example only. Upon loosening the lock mechanism 74, a user can compress the adjustable pitch arm assembly 52 to the desired position, and then re-tighten the lock mechanism 74 to hold the adjustable pitch arm assembly 52 at the desired position. Upon the user adjusting either the left-hand side or the right-hand side of the awning assembly 10, the user can move the awning assembly into the position of FIG. 11 or FIG. 12 where the awning is configured to drain rain water to one side or the other side. The user also is able to vary the length of the canopy 14, the amount of shade, the orientation of the canopy 14 and the shade that it provides, and set the awning assembly 10 in such a way as to cause light rain to roll off the awning. The user can then choose to collapse the adjustable pitch arm assembly 52 on the other side (i.e. the left-hand side or the right-hand side). Accordingly, the awning assembly 10 can be placed in a plurality of positions where it is either parallel to the ground at one of a plurality of positions such as the first deployed position of FIG. 1 or FIG. 2 or the second deployed position of FIG. 4 and FIG. 5; tilted to the left side (FIG. 11); or tilted to the right side (FIG. 12). Moreover, when the first adjustable pitch arm assembly 52 and the second adjustable pitch arm assembly are both placed in a collapsed position, the awning assembly 10 will be in the second deployed position of FIGS. 4 and 5. Thus, the canopy can be movable from the first deployed position to a first tilted position when the first adjustable pitch arm assembly 52 is manually adjusted from an extended position to a collapsed position. The second adjustable pitch arm assembly 52 can be maintained in the extended position. Likewise, the canopy is movable from a first deployed position to a second tilted position when the second adjustable pitch arm assembly is manually adjusted from an extended position to a collapsed position. The first adjustable pitch arm assembly 52 can be maintained in the extended position.

From any of the deployed positions or tilted positions, the awning assembly 10 can return to its original retracted position, shown in FIG. 3, without the user making any manual adjustments to either the first adjustable pitch arm assembly 52, such as on the right-hand side, or the second adjustable pitch arm assembly 52, such as on the left-hand side. While the lock mechanism 74 applies the clamping force to a wall in the first member 70 and a corresponding wall in the second member 72, the awning assembly 10 can provide a retraction force great enough to overcome the clamping force provided. By providing the relatively larger retraction force, the awning assembly 10 can be retracted even when the user accidentally leaves the adjustable pitch arm assembly 52 in the collapsed position, shown in FIG. 7, and even when the lock mechanism 74 is in the secured position. For example, the canopy 14 can also be movable from the first tilted position to the retracted position while the first adjustable pitch arm assembly 52 is in the collapsed position and the lock mechanism 74 is in a secured position. This is a situation where the retracting force, such as provided by an automatic retraction device, is greater than the clamping force provided by the lock mechanism 74 of the first adjustable pitch arm assembly 52. Likewise, the canopy 14 is movable from the second tilted position to the retracted position while the second adjustable pitch arm assembly is initially in the collapsed position when the lock mechanism 74 is in a secured position.

A second example can be provided where the canopy 14 is movable from a first deployed position to a second deployed position when the first adjustable pitch arm assembly 52 and the second adjustable pitch arm assembly are both manually adjusted from an extended position to a collapsed position. The canopy 14 is movable from the second deployed position to a retracted position without manually adjusting the first adjustable pitch arm assembly 52 or without manually adjusting the second adjustable pitch arm assembly. This is a situation where the retracting force, such as provided by an automatic retraction device, is greater than the clamping force provided by the lock mechanism 74 of the first adjustable pitch arm assembly 52.

In any of the examples, the first adjustable pitch arm assembly can be manually adjusted into one of a plurality of positions independent of the position of the second adjustable pitch arm assembly. Likewise, the second adjustable pitch arm assembly is manually adjusted into one of a plurality of positions independent of the position of the first adjustable pitch arm assembly.

In a further example, if one lock mechanism 74 is in an unsecured position and the other lock mechanism 74 is in a secured position, one end of the canopy 14 can automatically lower upon a certain amount of water accumulating on the awning fabric. For example, once a predetermined amount of water has collected on the canopy 14, the effective length of one of the adjustable pitch arm assemblies 52, on either the left or the right side, can automatically adjust to allow collected water to drain off the canopy 14. When this adjustable pitch arm assembly 52 is left in the unsecured position the adjustable pitch arm assembly 52 can freely move to a collapsed position. After the water drains off the canopy 14, the arm automatically returns to its original position once a reduced amount of weight is present on the canopy 14. Thus, by placing one of the lock mechanisms 74 in an unsecured position, water will roll off the awning assembly 10 and prevent damage during unattended periods of light rain as the awning assembly 10 can automatically move into either a first tilted position or a second tilted position.

The amount of force needed to sufficiently lower an edge of the canopy 14 so that some of the water is removed from the canopy is called the "predetermined load". The predetermined load can be 2 to 3 gallons of water or 16.7 to 25.0 pounds of water collect on the canopy 14. However, the predetermined load can vary depending on the canopy 14 size and type of the awning assembly 10. When the weight of the collected water is equal to, or greater than, the predetermined load, the awning assembly 10 is loaded. When loaded, an adjustable pitch arm assembly 52 will move from an extended position of FIG. 7 to a collapsed position of FIG. 8 to move at least one side edge of the canopy 14 automatically lower to drain at least some of the collected water from the canopy 14. When the collected water is less than the predetermined load, the awning assembly 10 is unloaded and the adjustable pitch arm assembly 52 will remain in the original extended position. The awning assembly 10 is in the first deployed position when collected water does not drain from the canopy 14.

In this further example, when the awning assembly 10 is loaded with water and one of the lock mechanisms 74 is in an unsecured position or one of the adjustable pitch arm assemblies 52 is adjusted to a collapsed position, the second member 72 of the unlocked adjustable pitch arm assembly 52 can slide into the first member 70, thereby shortening the effective length of the adjustable pitch arm assembly 52. If one of the two adjustable pitch arm assemblies 52 is in the collapsed position, the awning assembly 10 will be in either the first tilted position or the second tilted position. In the first tilted position or the second tilted position, the outer end of the canopy 14 slopes downwards towards the end of the extended arm 54 when the adjustable pitch arm assembly 52 is in the collapsed position. Water collected on the canopy 14, assisted by gravity, migrates toward the lowered corner of the canopy 14 and drains from the canopy 14. When the awning assembly 10 returns to the first deployed position, energy stored in a biasing mechanism within the first member 70 and the second member 72 can automatically lengthen the adjustable pitch arm assembly 52 thereby restoring the canopy rod 18 and the canopy 14 to the original position.

The clamping force of the locking mechanism 74 restricts the first adjustable pitch arm assembly from changing effective length. In an additional example, even when both of the lock mechanisms 74 are in the secured position, water will roll off the awning assembly 10 and prevent damage during unattended periods of light rain as the awning assembly 10 can eventually move into either a first tilted position, a second tilted position or the second deployed position. If the lock mechanism 74 is in the secured position, one end of the canopy 14 can still lower upon a certain amount of water accumulating on the awning fabric. The amount of water needed to lower the canopy is greater than if the lock mechanism 74 is in the unsecured position, as described above. The force of the water must be great enough to overcome the clamping force provided by the lock mechanism 74. Only when a relatively large amount of water is present, such as five times the amount of water necessary to move the adjustable pitch arm assembly 52 when the lock mechanism 74 is in the unsecured position, will the clamping force of the lock mechanism 74 be overcome. It thus takes a longer amount of time for the adjustable pitch arm assembly 52 to move into a different position to drain the water in comparison to when the lock mechanism 74 is in the unsecured position, as more water must accumulate. When loaded, the adjustable pitch arm assembly 52 can move from an extended position of FIG. 7 to a collapsed position of FIG. 8 to move at least one side edge of the canopy 14 lower to drain at least some of the collected water from the canopy 14. The awning assembly 10 is in the first deployed position when collected water does not drain from the canopy 14. For example, once a predetermined amount of water has collected on the canopy 14, the effective length of one of the adjustable pitch arm assemblies 52, on either the left or the right side, can eventually adjust to allow collected water to drain off the canopy 14. Water collected on the canopy 14, assisted by gravity, migrates toward the lowered corner of the canopy 14 and drains from the canopy 14. In addition, the clamping force provided by the lock mechanism 74 can prevent the adjustable pitch arm assembly 52 from returning to an extended position. The clamping force can still be a greater force than the force provided by a biasing mechanism that is configured to bias the adjustable pitch arm assembly 52 into the extended position.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An awning assembly, comprising:

a canopy having an inner edge for connection at a wall, and an outer edge;

a first arm assembly and a second arm assembly supporting opposite ends of said canopy;

a canopy rod connected to said canopy at the outer edge and having a first end and a second end each supported by one of said first arm assembly and said second arm assembly;

wherein the first arm assembly includes a first adjustable pitch arm assembly;

wherein manual adjustment of the first adjustable pitch arm assembly is configured to move the first end of the canopy rod;

wherein the first adjustable pitch arm assembly is manually adjustable between an extended position and a collapsed position;

wherein the first adjustable pitch arm assembly includes a first member movable relative to a second member; wherein the first adjustable pitch arm assembly includes a lock mechanism that is configured to be placed in a secured position to secure the first member relative to the second member in a position between the extended position and the collapsed position;

wherein the lock mechanism includes a knob with a threaded stud;

wherein the first adjustable pitch arm assembly is manually adjusted by turning the knob with the threaded stud wherein the threaded stud applies a clamping force to a wall in the first member and a corresponding wall in the second member;

wherein the clamping force of the knob restricts the first adjustable pitch arm assembly from changing effective length when said awning assembly is loaded;

wherein the second member includes a hole, the first member includes an elongate slot and the threaded stud extends through which the hole and the elongate slot such that the effective length is infinitely adjustable between the extended position and the collapsed position.

2. The awning assembly according to claim 1, wherein the canopy moves from a retracted position to a first deployed position to a second deployed position.

3. The awning assembly according to claim 1, wherein the second arm assembly includes a second adjustable pitch arm assembly; wherein manual adjustment of the second adjustable pitch arm assembly is configured to move the second end of the canopy rod.

4. The awning assembly according to claim 3, wherein the canopy is movable from a first deployed position to a first tilted position when the first adjustable pitch arm assembly is manually adjusted from an extended position to a collapsed position.

5. The awning assembly according to claim 4, wherein the canopy is movable from the first tilted position to a retracted position while the first adjustable pitch arm assembly is in the collapsed position.

6. The awning assembly according to claim 3, wherein the canopy is movable from a first deployed position to a second tilted position when the second adjustable pitch arm assembly is manually adjusted from an extended position to a collapsed position.

7. The awning assembly according to claim 6, wherein the canopy is movable from the second tilted position to a retracted position while the second adjustable pitch arm assembly is in the collapsed position.

8. The awning assembly according to claim 3, wherein the canopy is movable from a first deployed position to a second deployed position when the first adjustable pitch arm assembly and the second adjustable pitch arm assembly are both manually adjusted from an extended position to a collapsed position.

9. The awning assembly according to claim 8, wherein the canopy is movable from the second deployed position to a retracted position without manually adjusting the first adjustable pitch arm assembly or without manually adjusting the second adjustable pitch arm assembly.

10. The awning assembly according to claim 3, wherein the first adjustable pitch arm assembly is manually adjusted into one of a plurality of positions independent of a position of the second adjustable pitch arm assembly.

11. The awning assembly according to claim 3, wherein the second adjustable pitch arm assembly is manually adjusted into one of a plurality of positions independent of a position of the first adjustable pitch arm assembly.

12. The awning assembly according to claim 1, wherein the first arm assembly and the second arm assembly includes a base arm connected to said wall;

said first adjustable pitch arm assembly having an inner end pivotally connected to said base arm;

an extended arm having an inner end pivotally connected to said first adjustable pitch arm assembly and an outer end connected to and supporting said canopy rod; and a top arm having an inner end pivotally connected to said base arm above said first adjustable pitch arm assembly and an outer end pivotally connected to said extended arm.

13. The awning assembly according to claim 12, wherein the extended arm substantially conceals the first adjustable pitch arm assembly, the top arm, and the base arm when the canopy is in a retracted position.

14. The awning assembly according to claim 1, wherein the first adjustable pitch arm assembly includes a cross-member configured to limit a movement of the first member relative to the second member.

15. The awning assembly according to claim 1, wherein the clamping force of the knob restricts the first adjustable pitch arm assembly from changing effective length when said awning assembly is loaded.

16. The awning assembly according to claim 12, wherein at least one of said first arm assembly and said second arm assembly further includes a strut having an inner end connected to the base arm and an outer end connected to the top arm.

17. An awning assembly, comprising:

a canopy having an inner edge for connection at a wall, and an outer edge;

a first arm assembly and a second arm assembly supporting opposite ends of said canopy;

a canopy rod connected to said canopy and having a first end and a second end each supported by one of said first arm assembly and said second arm assembly;

wherein the first arm assembly includes a first adjustable pitch arm assembly;

wherein manual adjustment of the first adjustable pitch arm assembly is configured to move the first end of the canopy rod;

wherein the second arm assembly includes a second adjustable pitch arm assembly;

wherein manual adjustment of the second adjustable pitch arm assembly is configured to move the second end of the canopy rod;

wherein the first adjustable pitch arm assembly and the second adjustable pitch arm assembly are both manually adjustable between an extended position and a collapsed position;

wherein the canopy is movable from a first deployed position to a first tilted position when the first adjustable pitch arm assembly is manually adjusted from the extended position to the collapsed position;

wherein the canopy is movable from the first deployed position to a second tilted position when the second adjustable pitch arm assembly is manually adjusted from the extended position to the collapsed position;

wherein the canopy is movable from the first deployed position to a second deployed position when the first adjustable pitch arm assembly and the second adjustable pitch arm assembly are both manually adjusted from the extended position to the collapsed position; wherein the canopy is movable from the second deployed position to a retracted position without manually adjusting the first adjustable pitch arm assembly and without manually adjusting the second adjustable pitch arm assembly;

wherein the first adjustable pitch arm assembly includes a first member movable relative to a second member;

wherein the first adjustable pitch arm assembly includes a lock mechanism that is configured to be placed in a secured position to secure the first member relative to the second member in a position between the extended position and the collapsed position;

wherein the lock mechanism includes a knob with a threaded stud;

wherein the first adjustable pitch arm assembly is manually adjusted by turning the knob with the threaded stud wherein the threaded stud applies a clamping force to a wall in the first member and a corresponding wall in the second member;

wherein the clamping force of the knob restricts the first adjustable pitch arm assembly from changing effective length when said awning assembly is loaded;

wherein the second member includes a hole, the first member includes an elongate slot and the threaded stud extends through which the hole and the elongate slot such that the effective length is infinitely adjustable between the extended position and the collapsed position.

18. The awning assembly according to claim 17, wherein the first adjustable pitch arm assembly is manually adjusted into one of a plurality of positions independent of a position of the second adjustable pitch arm assembly.

19. The awning assembly according to claim 17, wherein the second adjustable pitch arm assembly is manually adjusted into one of a plurality of positions independent of a position of the first adjustable pitch arm assembly.

20. The awning assembly according to claim 17, each of said first arm assembly and said second arm assembly including:

a base arm connected to said wall, each of the first adjustable pitch arm assembly and the second adjustable pitch arm assembly having an inner end pivotally connected to said base arm;

an extended arm having an inner end pivotally connected to each of the first adjustable pitch arm assembly and the second adjustable pitch arm assembly and an outer end connected to and supporting said canopy rod; and a top arm having an inner end pivotally connected to said base arm above each of the first adjustable pitch arm assembly and the second adjustable pitch arm assembly and an outer end pivotally connected to said extended arm.

21. The awning assembly according to claim 20, wherein the extended arm substantially conceals the corresponding adjustable pitch arm assembly, the top arm, and the base arm when the canopy is in the retracted position.

22. The awning assembly according to claim 17, wherein the first adjustable pitch arm assembly includes a cross-member configured to limit a movement of the first member relative to the second member.

23. The awning assembly according to claim 20, wherein at least one of said first arm assembly and said second arm assembly further includes a strut having an inner end connected to the base arm and an outer end connected to the top arm.

* * * * *